United States Patent [19]

Rosenband

[11] 4,270,661

[45] Jun. 2, 1981

[54] BATTERY STORAGE RACK

[75] Inventor: Phillip Rosenband, Hammond, Ind.

[73] Assignee: Parsteel Products & Services Company, Inc., Chicago Heights, Ill.

[21] Appl. No.: 35,740

[22] Filed: May 3, 1979

[51] Int. Cl.[3] ..... A47F 5/10

[52] U.S. Cl. ..... 211/49 D; 211/191

[58] Field of Search ..... 211/490, 184, 190, 191, 211/183, 151, 182, 186, 187

[56] References Cited

U.S. PATENT DOCUMENTS

| | | | |
|---|---|---|---|
| 1,711,329 | 4/1929 | Short | 211/49 D |
| 3,063,534 | 11/1962 | St. Amour | 211/49 D X |
| 3,900,112 | 8/1975 | Azzi et al. | 211/49 D X |
| 4,106,630 | 8/1978 | Rosenband | 211/191 |
| 4,183,438 | 1/1980 | Huczek | 211/49 D |

FOREIGN PATENT DOCUMENTS

| | | | |
|---|---|---|---|
| 43097 | 1/1970 | Finland | 211/49 D |

*Primary Examiner*—Roy D. Frazier
*Assistant Examiner*—Robert W. Gibson, Jr.
*Attorney, Agent, or Firm*—Marvin N. Benn

[57] ABSTRACT

A storage rack assembly includes a plurality of vertically disposed corner posts and a plurality of horizontally disposed beams interconnected between the corner posts for defining a box-like structure having a front face and a rear face. A plurality of elongate partition members are interconnected in spaced parallel relationship between a beam forming part of the front face and a beam forming part of the rear face, each partition member comprising a longitudinal base portion, a longitudinal leg portion extending upwardly from the center of the base portion and a pair of longitudinal shoulders extending upwardly from each edge of the base portion. Each partition member further includes longitudinal mating means depending from the center of the base portion for mating with suitable slots formed in the beams of the front and rear faces of the assembly. Each pair of adjacent partition members thereby defines a channel for receiving items of inventory, the channel comprising the center legs of the adjacent partition members for guiding an item of inventory therebetween and one of the shoulders of each partition member on which the item of inventory is slidable between the rear and front faces of the assembly.

15 Claims, 11 Drawing Figures

BATTERY STORAGE RACK

BACKGROUND OF THE INVENTION

The present invention relates to storage rack assemblies and particularly storage rack assemblies of the vertically adjustable type which are adapted for housing inventory such as storage batteries and the like.

In order to economically market various sorts of inventory items including, for example, automotive storage batteries and the like, it is highly desirable to provide a facility whereby the items may be suitably stored and dispensed from as needed. In the case of relatively heavy items of inventory, e.g. automotive storage batteries, the storage facility should be constructed in a manner so as to exhibit a sufficient degree of structural stability to adequately support a number of the inventory items. In addition, to further enhance the desirability of the storage facility, it should be configured so as to advantageously permit the structure to be assembled and installed in a rapid and straightforward manner.

When considering items of inventory such as automotive storage batteries, it is also of considerable importance that a measure of control be exercised over the manner in which the items are dispensed from the storage facility. In particular, it is often necessary or desirable to control the inventory flow on a first in-first out basis. In an inventory control system of this type, the older items first placed within the storage facility are also preferably the first items dispensed from the facility. In this manner, the deleterious effects of aging and the like are minimized while various benefits attributable to disposing of older inventory are realized.

Numerous storage facilities are known which include means for housing a wide variety of different types of inventory items. Exemplary of such prior art storage facilities is the storage rack assembly disclosed in U.S. Pat. No. 4,106,630 issued Aug. 15, 1978 to Rosenband. The storage rack assembly disclosed in the Rosenband patent, as well as various other rack assemblies discussed therein, typically includes four vertically disposed corner posts interconnected by a plurality of horizontally disposed beams by means of cooperating tabs and slots formed in the posts and beams. The beams of this box-shaped framework are aligned in spaced apart planes for supporting a plurality of shelf panels which are adapted for carrying a wide range of items. The particular construction of the interlocking tabs and slots employed in association with the storage rack assembly disclosed in the above Rosenband patent are particularly advantageous in that provision is made for a highly stable locking mechanism characterized by a three point contact between a tab on each beam and its mating corner post slot.

Storage rack assemblies of the type discussed above while adequate for certain purposes are not considered to provide sufficient inventory control when used for storing and dispensing inventory items such as automotive storage batteries. In this regard, these prior art storage rack assemblies are not configured for facilitating a first in-first out type inventory control system and, moreover, normally lack sufficient structural integrity to accommodate heavy items of inventory such as automotive storage batteries.

The improved storage rack assembly of the present invention differs from the previously proposed rack assemblies in the provision and construction of a plurality of spaced elongate partition members interconnected between each pair of opposed rack beams in lieu of the heretofore used shelf panels. The partition members, in addition to greatly increasing the structural stability of the rack assembly, provide a convenient means whereby positive inventory control of the items stored within the rack may be maintained.

SUMMARY OF THE INVENTION

According to the present invention there is provided a storage rack assembly comprising a plurality of vertically disposed corner posts and a plurality of horizontally disposed beams interconnected between the corner posts for defining a box-like structure having a front face and a rear face. A plurality of elongate partition members are interconnected in spaced parallel relationship between a first beam forming part of the front face and a second beam forming part of the rear face of the assembly. Each partition member comprises a horizontally disposed base portion extending longitudinally between the first beam and the second beam, a central leg portion extending upwardly from and longitudinally of the base portion and a pair of shoulders extending upwardly from each edge and longitudinally of the base portion. Each partition member further includes a neck member extending downwardly from the center of the base portion in coaxial alignment with the center leg and a lateral locking bar depending therefrom. The neck members mate with suitable slots formed in the beams of the front and rear faces of the assembly so that the partition members are arranged for defining a plurality of inventory receiving channels, each channel comprising the center legs of the adjacent partition members for guiding the item of inventory therebetween and one of the shoulders of each partition member on which the item of inventory is slidable between the front and rear faces of the assembly. As a result of this construction, a highly stable structure is realized which is conveniently utilized for achieving first in-first out inventory control.

DESCRIPTION OF THE PREFERRED EMBODIMENT

In the description following herein, the improved storage rack assembly of the invention is described for use in association with automotive storage batteries. It is to be realized, however, that such has been done for illustrative purposes only and is not intended to be of a limiting nature. Accordingly, it will be appreciated that the storage rack assembly of the invention is equally useful for storing and dispensing other diverse types of inventory items and especially those items requiring positive inventory control together with highly secure structural support.

Figure 1:
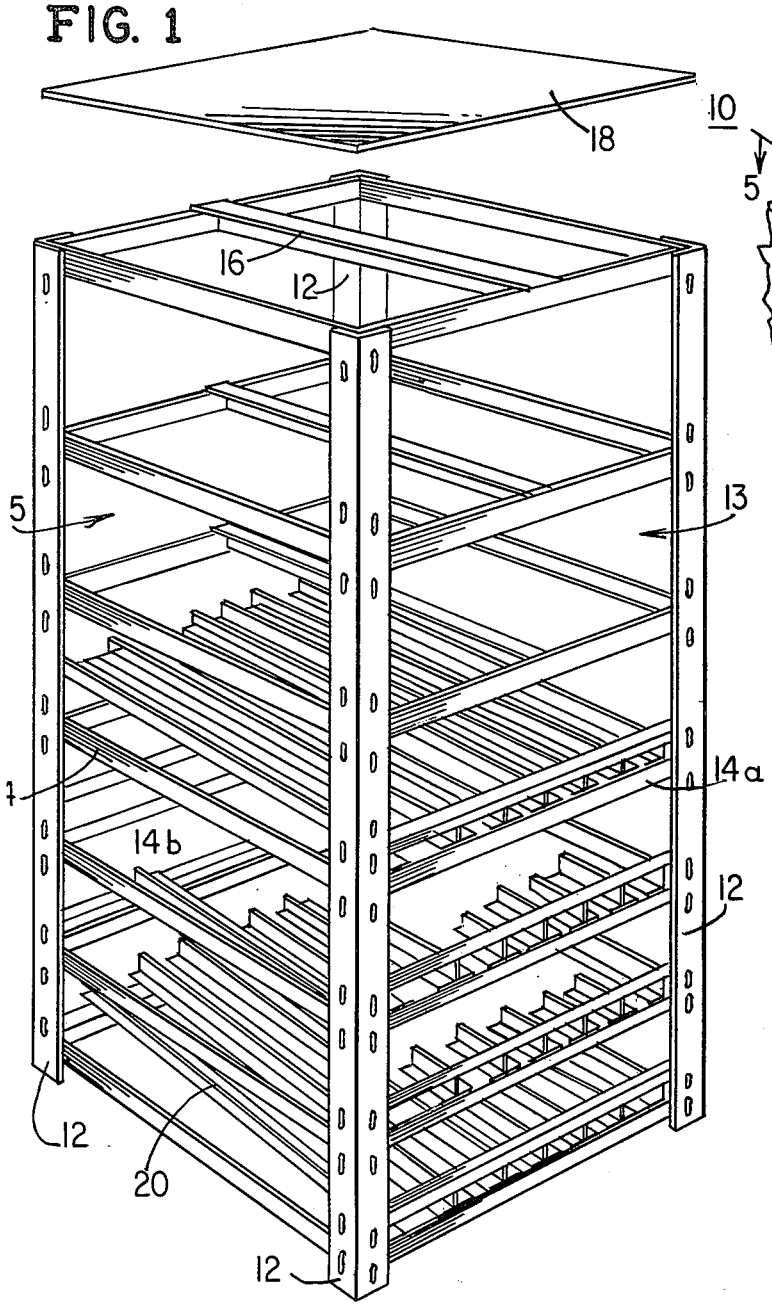
FIG. 1 is a perspective view of a storage rack assembly constructed according to the teachings of the present invention.
Figure 2:
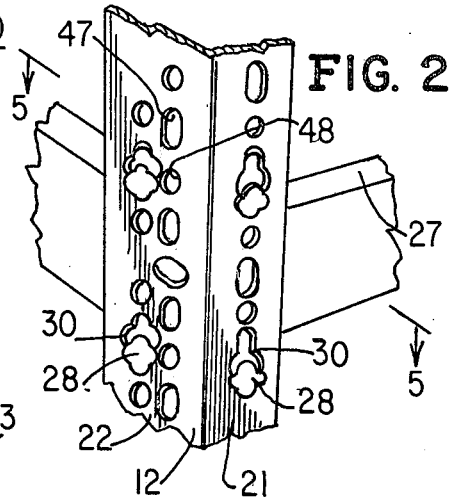
FIG. 2 is a fragmentary enlarged perspective view of a corner of the assembly shown in FIG. 1 and showing the connection between a post and two beams.
Figure 3:
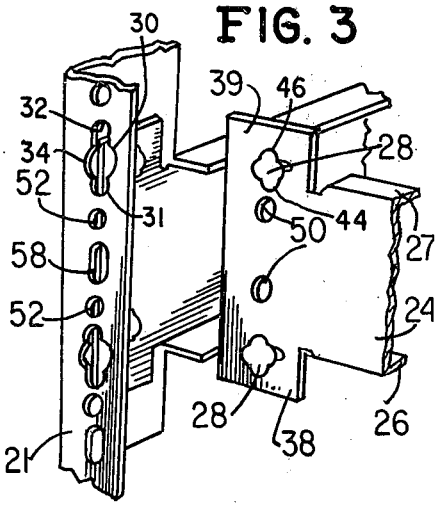
FIG. 3 is a fragmentary, perspective view of the corner shown in FIG. 3 but rotated 90° and with one beam shown in exploded relationship to the post.
Figure 4:
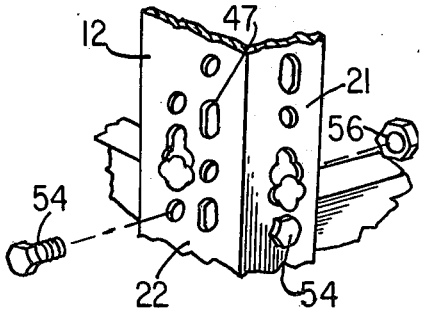
FIG. 4 is a fragmentary perspective view similar to FIG. 2 and showing the use of fasteners received through aligned holes in the beams and post to provide additional securement between the beams and post.
Figure 5:
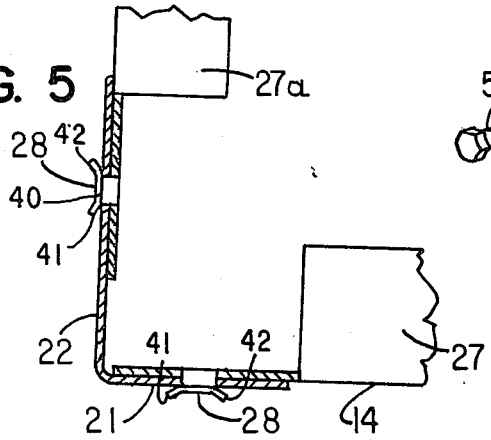
FIG. 5 is a sectional view taken along line 5—5 of FIG. 2.

Referring now to the drawings in greater detail, a storage rack assembly 10 constructed in accordance with the teachings of the present invention is generally shown in FIG. 1. The assembly 10 includes four vertically disposed corner posts 12 interconnected by a plurality of horizontal beams 14. In the illustrated embodiment, all of the beams 14 are of equal length although such is not a necessary limitation. Thus, the beams forming the front face 13 of assembly 10, these beams being identified by reference numeral 14*a*, may be shorter than the beams 14 forming either side faces of the assembly. For obvious reasons, the beams forming the rear face 15 of assembly 10, these beams being identified by reference numeral 14*b*, will be of the same length as the beams 14*a*. As will be described in greater detail below, the beams 14, 14*a* and 14*b* are all similar in cross-section although, as described above, not necessarily identical in length.

In the illustrated embodiment seven tiers are provided for supporting different items of inventory. The top three tiers each includes a shelf support channel 16 transversely interconnected between a front beam 14*a* and a rear beam 14*b* in parallel spaced relationship between a pair of side beams 14. A generally planar shelf member 18 is supported by the beams 14, 14*a* and 14*b* and shelf support channel 16 of each of the top three tiers. Articles of various types may therefore be conveniently stored on the generally flat surfaces defined by the shelf members 18 of the three top tiers of assembly 10.

Of particular significance in regard to the present invention are the four lower tiers of assembly 10. As will be explained in greater detail below, in each of these tiers a plurality of uniquely configured elongate partition members 20 are interconnected in spaced parallel relationship between a front beam 14*a* and a rear beam 14*b*. The partition members 20, which are utilized in lieu of the shelf members 18 of the three top tiers of assembly 10, are adapted for defining a plurality of transversely extending channels between the front and rear beams 14*a* and 14*b* along which a number of automotive storage batteries may be slid from the rear face 15 to the front face 13 of assembly 10. The spacing between the tiers is suitably adjusted for providing sufficient clearance between the individual tiers to prevent any damage to the batteries stacked therein. Thus, to provide the heretofore described inventory control, the storage batteries are preferably placed within a channel formed by partitions 20 from the rear face 15 of assembly 10 and then slid forward within the channels toward the assembly's front face 13. The batteries are subsequently dispensed from the front face 13 of the assembly for achieving first in-first out inventory control.

It will be appreciated that the arrangement described above in relation to the general configuration of assembly 10 is exemplary only and that a wide variety of other configurations are contemplated as being within the scope of the invention. Thus, for example, the assembly 10 may be configured having different numbers of tiers and the tiers including partition members 20 may comprise the entire assembly or any desired portion thereof.

Returning now to the drawings, FIGS. 2–5 illustrate the general construction of corner posts 12 and beams 14. While this construction is largely shown in the previously discussed Rosenband patent, it is being repeated herein for purposes of clarity and to highlight certain aspects of the present invention. Accordingly, as most clearly shown in FIG. 2, each post 12 includes two supporting wall portions 21 and 22 which are integral with each other and which extend from each other at right angles to form an L-shaped cross-section. It will be noted, however, that supporting wall 22 is somewhat wider than supporting wall 21.

Each beam 14, 14*a* and 14*b* includes a vertically disposed wall portion 24 and two horizontally disposed flange portions 26 and 27 which are integral with and extend from the lower and upper edges, respectively, of the wall portion 24. The beams 14, 14*a* and 14*b* are secured to the walls 21 and 22 of the posts 12 by means of tabs 28 which are received through cooperating openings 30 in the wall portions 21 and 22 of the posts. Each beam has two tabs struck from each end of the wall portion 24 and the openings 30 in supporting walls 21 and 22 are spaced apart so that each adjacent pair of openings 30 are adapted to receive a pair of tabs 28.

Each opening 30 is generally elongate having opposed, slot-shaped rounded ends 31 and 32 which lie on a line coaxial with the elongate axes of the posts 12. Also, each opening 30 has a wider generally circular portion 34 in the central area thereof. With this configuration of the opening 30, one of the tabs 28 can be easily inserted through the wider portion 34 and then moved toward one of the ends 31 or 32 of the opening 30.

Each of the tabs 28 also has a central portion 40 which is spaced outwardly from the front face of the wall portion 24 and which has two opposed edges or locking ears 41 and 42 extending outwardly therefrom. Further, each tab 28 includes a connecting portion extending between the central portion 40 and the front face of wall portion 24 of the beams. The connecting portion is defined by two arms 44 and 46 which extend outwardly from the wall portion 24 toward each other and to the central portion 40 and which have a lateral extent less than the lateral extent of the central portion 40 and less than the width of the slot-shaped rounded ends 31 and 32 of the opening 30 to facilitate insertion of one of the arms 44 or 46 therein.

When fastening a beam 14, 14*a* or 14*b* to a post 12 the central portion 40 of the tab 28 with opposed ears 41 and 42 is inserted through the wider central area 34 of the opening 30. Then, the beam 14 is moved downwardly to bring the central portion 40 over the rounded end 31 with the ears 41 and 42 extending over the front face of the supporting wall 21 and in contact therewith. At the same time, the arm 44 of the connecting portion is brought into contact with the rounded edge of the end 31 of the opening 30. In this way, a three point contact is made between the tab and the supporting wall 21 of the post 12 providing an extremely stable interconnection therebetween.

In addition to the interlocking of the posts 12 and beams 14 by means of the tabs 28 and the openings 30, the beams 14, 14*a* and 14*b* and the supporting walls 21 and 22 of the posts 12 are all provided with holes therein, such as are shown at 50 and 52, which are adapted to be aligned and mate with each other when the tabs 28 are received in the openings 30 and locked in place and then to receive fasteners therein. Also, the openings 30 in the supporting wall 22 are spaced a further distance from the junction between the walls 21 and 22 than are the openings 30 in the wall 21. This permits the formation of additional oval and circular holes in supporting wall 22 for any desired purpose.

As previously mentioned, the foregoing technique for interlocking the posts 12 and beams 14 is fully disclosed in the referenced Rosenband patent. The present invention deals largely with the partition members 20 which are preferably utilized in association with a framework of assembly 10 which has previously been interconnected in this manner, although it is also contemplated that other suitable techniques of interconnecting the posts 12 and beams 14 may also be employed.

Figure 6:
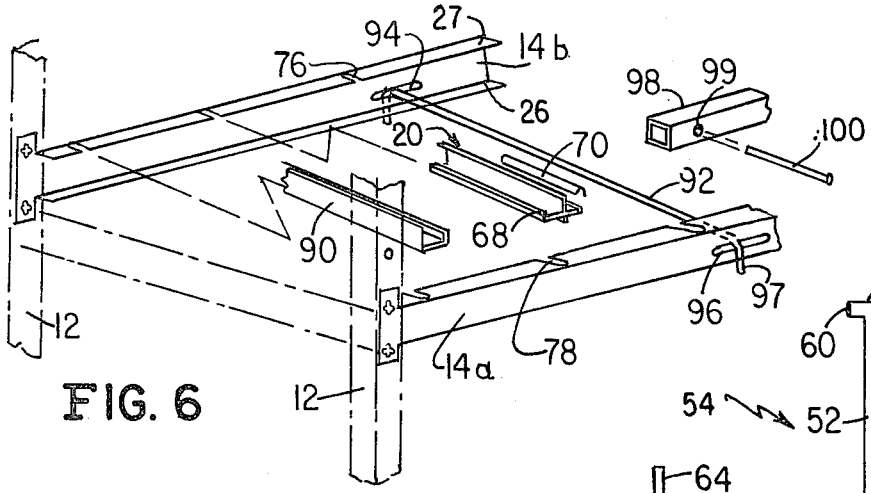
FIG. 6 is an exploded view illustrating the partition member of the invention and its method of interconnection to the storage rack assembly of FIGS. 1–5.
Figure 7:
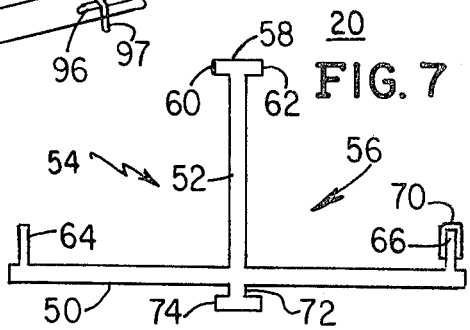
FIG. 7 is a front elevation view of the partition member shown in FIG. 6.

Partition members 20 and their method of interconnection in association with assembly 10 is most clearly illustrated in FIG. 6 and FIG. 7. Each partition member 20, which preferably comprises an extruded aluminum structure, includes an elongate base portion 50 extending transversely between a front face beam 14*a* and a rear face beam 14*b*. A central leg portion 52 extends upwardly from base portion 50 bifurcating partition member 20 into two sections 54 and 56, each section being the mirror image of the other. The end of leg portion 52 opposite base portion 50 forms a guide bar 58 having a vertical surface 60 extending within section 54 of partition member 20 between front beam 14*a* and rear beam 14*b*. Guide bar 58 defines a second similar vertical surface 62 extending within section 56 of partition member 20 between front beam 14*a* and rear beam 14*b*. As will be explained in further detail, surfaces 60 and 62 of guide bar 58 comprise a pair of guide surfaces for batteries stored within assembly 10.

A pair of upstanding shoulders 64 and 66 are formed at the distal ends of base portion 50, each also extending transversely between a front face beam 14*a* and a rear face beam 14*b*. Shoulder 64, which extends to a height above base portion 50 substantially less than the height of guide bar 50 above base portion 50, thereby defines the outer boundary of section 54 while identically configured shoulder 66 defines the outer boundary of section 56. As will be explained later, the function of shoulders 64 and 66 is to provide horizontal surfaces on which batteries stored in the assembly 10 may be slid from the assembly's rear face 15 to its front face 13. To facilitate such, lengths of split plastic tubing, such as shown at 68 and 70 in FIG. 6, may be provided overlying the shoulders 64 and 66 respectively. The lengths of plastic tubing 68 and 70 also serve to protect the bottom surface of a battery when slid therealong.

Partition member 20 further includes a relatively short neck member 72 depending from base portion 50 in coaxial alignment with the upstanding central leg portion 52. The end of neck member 72 opposite base portion 50 forms a horizontally disposed locking bar 74 whose configuration is substantially identical to that of guide bar 58.

With reference to FIG. 6, it will be observed that the upper flange 27 of rear face beam 14*b* includes a plurality of spaced generally U-shaped slots 76. The upper flange 26 of front face beam 14*a* similarly includes a plurality of spaced generally U-shaped slots 78, with each slot 78 of the front face beam 14*a* being in coaxial alignment with one of the slots 76 of the rear face beam 14*b*. To facilitate assembly of the storage rack 10, the slots are preferably formed such that the transverse dimensions of the slots 78 are substantially greater than the transverse dimensions of the slots 76. Moreover, the slots are formed such that the lateral extent of the neck member 72 of partition member 20 is slightly less than the transverse dimensions of slots 76 while the lateral extent of locking bar 74 is somewhat greater than the transverse dimensions of the slots 76 but less than the transverse dimensions of slots 78.

As most clearly shown in FIG. 6, each partition member 20 is interconnected between a front face beam 14*a* and a rear face beam 14*b* by inserting one of the distal ends of a neck member 72 into a slot 76 of the rear face beam 14*b*. The opposite end of neck member 72 together with locking bar 74 is then lowered through the aligned slot 78 in the front face beam 14*a*. The bottom surface of the base portion 50 at the distal ends of partition member 20 will therefore rest upon the top surfaces of flanges 26 and 27 suspending the partition member between the front and rear face beams 14*a* and 14*b* respectively. The partition member 20 is thereby pivotally retained between the front and rear face beams 14*a* and 14*b* of assembly 10 with both lateral and longitudinal displacement of the partition members being prevented due to the cooperative action between the neck member 72 and the slots 76 and 78.

Figure 8:
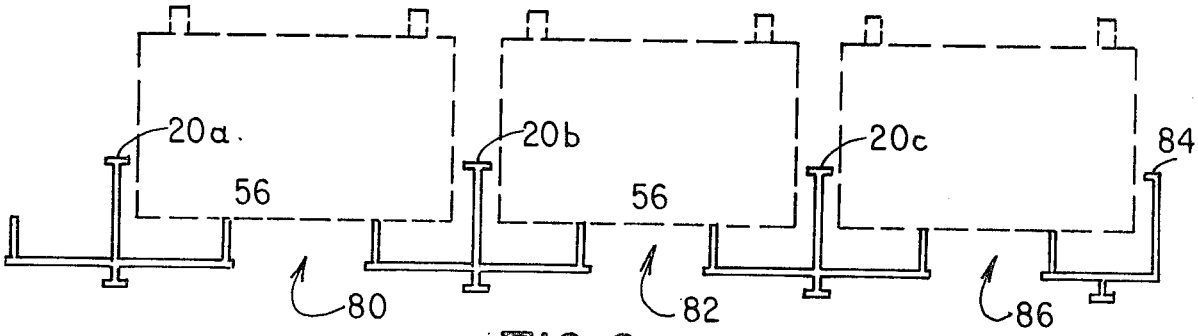
FIG. 8 schematically illustrates a number of partition members arranged for forming a series of inventory receiving channels.

As best illustrated in FIG. 1, each of the lower four tiers of assembly 10 includes a plurality of partition members 20 suspended between associated front and rear face beams 14*a* and 14*b* in the manner described above. FIG. 8 illustrates three adjacent ones 20*a*, 20*b* and 20*c* of the partition members 20 of any one of the tiers of assembly 10. It will be seen that the section 56 of one of the partition members forms with the section 54 of the adjacent partition member a channel suitable for receiving an automotive storage battery which is shown in dotted line in the figure. For example, section 56*a* of partition member 20*a* forms with section 54*b* of partition member 20*b* a first channel 80 which, of course, extends transversely between a front face beam 14*a* and a rear face beam 14*b*. Channel 80 includes the interiorly disposed guide surfaces 62*a* and 60*b* and the shoulders or slides 66*a* and 64*b*. Partition member 20*b* and partition member 20*c* define a similar channel 82. When utilizing the channels, e.g. channels 80 and 82, of assembly 10, it is contemplated that the automotive batteries will be initially placed in a channel from the rear face 15 of assembly. The battery, which is supported on a pair of shoulders 64, 66 is then slid toward the front face 13 of the assembly 10 while being constrained from movement in a lateral direction by the guide surfaces 60, 62. Additional batteries may similarly be placed within the channel until its entire length is occupied. Contrary to the placement of batteries within a channel for storage, dispensing of batteries is effected from the front face of assembly 10. This method of utilization of the channels formed by partition members 20 insures inventory control wherein the inventory is dispersed on a first in-first out basis.

Figure 10:
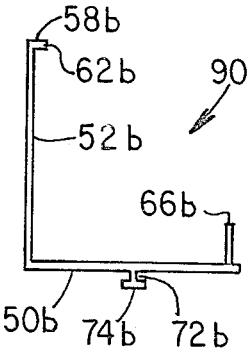
FIG. 10 is a front elevation view of a partition member comprising the mirror image of the member illustrated in FIG. 9.
Figure 9:
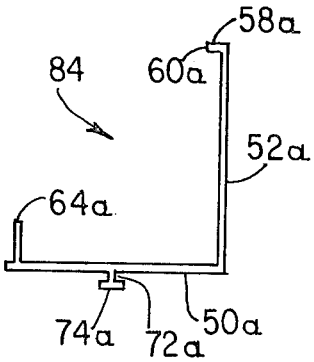
FIg. 9 is a front elevation view of a modified partition member of the present invention.

Upon interconnecting the partition members 20 within assembly 10, it will be observed that the outermost members in each tier, e.g. partition member 20*c* of FIG. 8, cooperate with only one adjacent partition member thereby forming only a single inventory receiving channel. This is to be contrasted with the inner partition members, e.g. partition member 20*b*, each of which cooperates with two adjacent members for defining two inventory receiving channels. Referring to FIG. 9, a generally L-shaped partition member 84 is illustrated which may be utilized in association with the outermost partition members of each tier of assembly 10 to form an additional inventory receiving channel. Partition member 84 is shown in FIG. 8 immediately to the right of member 20*c* and forms in cooperation therewith an additional channel 86. Referring back to FIG. 9, it will be seen that partition member 84 conforms very nearly to section 54 of a partition member 20. Thus, the partition member 84 includes a base portion 50*a*, a shoulder 64*a*, a central leg portion 52*a* and a guide bar 58*a* forming a guide surface 60*a*. Neck member 72*a* and depending locking bar 74*a* are disposed centrally of base 50*a* rather than in coaxial alignment with central leg portion 52*a* to increase the stability of the structure when suspended between a front and rear face beam 14*a* and 14*b*. A similar structure, but comprising the mirror image of partition member 84 may be utilized in association with partition member 20*a* of FIG. 8 to form an additional inventory receiving channel at the opposite end of the tier. Such a structure is shown at 90 in FIG. 10 and will be seen to very nearly conform to section 56 of a partition member 20. Thus, partition member 90 includes a base portion 50*b*, a shoulder 66*b*, a central leg portion 52*b* and a guide bar 58*b* forming a guide surface 62*b*. Further, as in the case of partition member 84, partition member 90 includes a centrally disposed neck member 72*b* and a depending locking bar 74*b*. The partition members 84 and 90 are suspended between a front and rear face beam 14*a* and 14*b* by means of mating neck members 72*a* and 72*b* with slots 76 and 78 just as described before.

Figure 11:
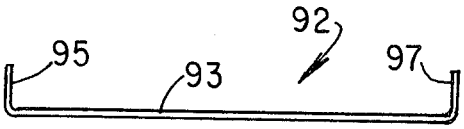
FIG. 11 is a perspective view of the locking rod shown in FIG. 6.

With certain items of inventory, e.g. automotive storage batteries, the assembly 10 may be subjected to substantial loads and tend to spread under the weight. To prevent such spreading of assembly 10 it has been found useful to utilize a locking or tie rod 92, see FIG. 11, which is disposed between a pair of oblong apertures 94 and 96 aligned centrally of the front and rear face beams 14*a* and 14*b*. Tie rod 92 comprises an elongate rod-like central portion 93 and a pair of transverse locking ears 95 and 97. In use, the tie rod 92 is inserted through oblong apertures 94 and 96 with the axis of its ears 95 and 97 parallel to the major axis of the apertures. The tie rod is configured so that the ears will overlie the outer surfaces of the front and rear face beams 14*a* and 14*b*. The tie rod is next rotated about 90° orienting the axis of the ears 95 and 97 in transverse relationship with the major axis of apertures 94 and 96. Since the ears 95 and 97 are substantially longer than the minor axis of the apertures 94 and 96, the tie rod 92 effectively restrains the beams 14*a* and 14*b* from spreading outwardly when subjected to a large load.

Referring back to FIG. 6, a stop bar 98 is preferably secured between the two corner posts 12 forming the front face 13 of assembly 10, the stop bar 98 being horizontally disposed just slightly above the guide bars 58 illustrated in the figure is square in cross-section, although other configurations may be utilized, and is secured between the corner posts 12 by fasteners 100 which pass through suitable apertures 99 formed in the distal ends of the stop bar 98 and the holes 50 located in the corner posts 12. The function of stop bar 98 is to restrain or stop automotive batteries placed within a channel of assembly 10 from being slidingly displaced beyond the front face 13 of the assembly.

While a particular embodiment of the present invention has been shown and described, it will be obvious to those skilled in the art that various changes and modifications may be made without departing from the invention in its broader aspects. The aims of the appended claims, therefore, is to cover all such changes and modifications as fall within the true spirit and scope of the invention.

What is claimed is:

1. In a storage rack assembly of the type having a plurality of vertically disposed corner posts and a plurality of horizontally disposed beams interconnected between the corner posts for defining a box-like structure having a front face and a rear face, said corner posts each including a plurality of spaced apertures defining a central area and a pair of opposed narrower end areas arranged in coaxial alignment with said posts, said beams each including at least one load carrying tab projecting from one end thereof and characterized by a central portion spaced from the beam, a pair of connecting arms extending from opposite sides of the central portion to the beam and a pair of opposed ear portions extending from the central portion and spaced from the beam, said apertures and tabs mating for interconnecting the beams and posts wherein one of said connecting arms bears against one of said end areas with said opposed ear portions contacting the post adjacent said aperture, the improvement comprising a plurality of elongate partition members interconnected in spaced parallel relationship between a first beam forming part of said front face and a second beam forming part of said rear face, each of said partition members comprising a horizontally disposed base portion extending between said first and second beams, a leg portion extending upwardly from the center and longitudinally of said base portion, a guide bar horizontally disposed along the length of the edge of said leg portion opposite said base portion, said guide bar including two vertically disposed guide surfaces extending laterally from opposite sides of said leg portion and a pair of shoulders extending upwardly from each edge and longitudinally of said base portion to a height less than the height which said leg portion extends above said base portion whereby, each two adjacent ones of said plurality of partition members defines a channel for receiving an item of inventory, said channel comprising the center legs of each of said adjacent partition members for guiding said item of inventory therebetween and one of said shoulders of each of said adjacent partition members on which said item of inventory is slidable between said first beam and said second beam.

2. The assembly according to claim 1 including a stop bar interconnected between the corner posts defining the front face of said assembly near said guide bar of said partition member.

3. In a storage rack assembly of the type having a plurality of vertically disposed corner posts and a plurality of horizontally disposed beams interconnected between the corner posts for defining a box-like structure having a front face and a rear face, said corner posts each including a plurality of spaced apertures defining a central area and a pair of opposed narrower end areas arranged in coaxial alignment with said posts, said beams each including at least one load carrying tab projecting from one end thereof and characterized by a central portion spaced from the beam, a pair of connecting arms extending from opposite sides of the central portion to the beam and a pair of opposed ear portions extending from the central portion and spaced from the beam, said apertures and tabs mating for interconnecting the beams and posts wherein one of said connecting arms bears against one of said end areas with said opposed ear portions contacting the post adjacent said aperture, the improvement comprising a plurality of elongate partition members interconnected in spaced parallel relationship between a first beam forming part of said front face and a second beam forming part of said rear face, each of said partition members comprising a horizontally disposed base portion extending between said first and second beams, a leg portion extending upwardly from the center and longitudinally of said base portion and a pair of shoulders extending upwardly from each edge and longitudinally of said base portion to a height less than the height which said leg portion extends above said base portion, each of said first and second beams including a horizontal flange extending inwardly of said box-like structure, each of said flanges including a plurality of generally U-shaped slots with each slot of said first beam being arranged in coaxial alignment with a slot of said second beam, and further including mating means extending downwardly from and longitudinally of the base portion of each of said partition members and mateable with a pair of said opposed slots for interconnecting said partition member between said first and second beams whereby, each two adjacent ones of said plurality of partition members defines a channel for receiving an item of inventory, said channel comprising the center legs of each of said adjacent partition members for guiding said item of inventory therebetween and one of said shoulders of each of said adjacent partition members on which said item of inventory is slidable between said first beam and said second beam.

4. The assembly according to claim 3 wherein said mating means comprises a neck member extending downwardly from said base portion in coaxial alignment with said leg portion and a locking bar depending from said neck member and having a lateral extent larger than said neck member, said neck member being received within said opposed slots with the bottom surface of said base portion engaging the top surfaces of said flanges.

5. The assembly according to claim 4 wherein the transverse dimensions of said slots formed in the flange of said second beam are less than that of the slots formed in the flange of said first beam, the transverse dimensions of said locking bar being greater than that of said slots formed in the flange of said second beam and less than that of said slots formed in the flange of said first beam.

6. The assembly according to claim 5 including a length of plastic tubing overlying said shoulders of said partition member.

7. The assembly according to claim 4 wherein said partition member comprises an extruded aluminum structure.

8. The assembly according to claim 3 wherein said first and second beams each includes a vertical wall depending from its respective one of said flanges, each of said walls having an aperture formed therein and arranged in coaxial alignment with each other, and further including a locking rod extending between said first and second beams and through said apertures, said locking rod including bearing means extending from either end thereof for engaging the outer surfaces of said vertical walls for preventing said beams from spreading under a heavy load.

9. A storage rack assembly comprising:

a plurality of vertically disposed corner posts;

a plurality of horizontally disposed beams interconnected between the corner posts for defining a box-like structure having a front face and a rear face; and a plurality of elongate partition members interconnected in spaced parallel relationship between a first beam forming part of said front face and a second beam forming part of said rear face, each of said partition members comprising a horizontally disposed base portion extending between said first and second beams, a leg portion extending upwardly from the center and longitudinally of said base portion, a guide bar horizontally disposed along the length of the edge of said leg portion opposite said base portion, said guide bar including two vertically disposed guide surfaces extending laterally from opposite sides of said leg portion and a pair of shoulders extending upwardly from each edge and longitudinally of said base portion to a height less than the height which said leg portion extends above said base portion whereby, each two adjacent ones of said plurality of partition members defines a channel for receiving an item of inventory, said channel comprising the center legs of each of said adjacent partition members for guiding said item of inventory therebetween and one of said shoulders of each of said adjacent partition members on which said item of inventory is slidable between said first beam and said second beam.

10. The assembly according to claim 9 including a stop bar interconnected between the corner posts defining the front face of said assembly near said guide bar of said partition member.

11. A storage rack assembly comprising:

a plurality of vertically disposed corner posts;

a plurality of horizontally disposed beams interconnected between the corner posts for defining a box-like structure having a front face and a rear face; and a plurality of elongate partition members interconnected in spaced parallel relationship between a first beam forming part of said front face and a second beam forming part of said rear face, each of said partition members comprising a horizontally disposed base portion extending between said first and second beams, a leg portion extending upwardly from the center and longitudinally of said base portion and a pair of shoulders extending upwardly from each edge and longitudinally of said base portion to a height less than the height which said leg portion extends above said base portion, each of said first and second beams including a horizontal flange extending inwardly of said box-like structure, each of said flanges including a plurality of generally U-shaped slots with each slot of said first beam being arranged in coaxial alignment with a slot of said second beam, and further including mating means extending downwardly from and longitudinally of the base portion of each of said partition members and mateable with a pair of said opposed slots for interconnecting said partition member between said first and second beams whereby, each two adjacent ones of said plurality of partition members defines a channel for receiving an item of inventory, said channel comprising the center legs of each of said adjacent partition members for guiding said item of inventory therebetween and one of said shoulders of each of said adjacent partition members on which said item of inventory is slidable between said first beam and said second beam.

12. The assembly according to claim 11 wherein said mating means comprises a neck member extending downwardly from said base portion in coaxial alignment with said leg portion and a locking bar depending from said neck member and having a lateral extent larger than said neck member, said neck member being received within said opposed slots with the bottom surface of said base portion engaging the top surfaces of said flanges.

13. The assembly according to claim 12 wherein the transverse dimensions of slots formed in the flange of said second beam are less than that of the slots formed in the flange of said first beam, the transverse dimensions of said locking bar being greater than that of said slots formed in the flange of said second beam and less than that of said slots formed in the flange of said first beam.

14. The assembly according to claim 12 wherein said partition member comprises an extruded aluminum structure.

15. The assembly according to claim 11 wherein said first and second beams each includes a vertical wall depending from its respective one of said flanges, each of said walls having an aperture formed therein and arranged in coaxial alignment with each other, and further including a locking rod extending between said first and second beams and through said apertures, said locking rod including bearing means extending from either end thereof for engaging the outer surfaces of said vertical walls for preventing said beams from spreading under a heavy load.

* * * * *